United States Patent [19]

Grant

[11] 4,000,574

[45] Jan. 4, 1977

[54] RIB FOR HANDGUN

[75] Inventor: Richard F. Grant, South Windsor, Conn.

[73] Assignee: The Poly-Choke Company, Incorporated, East Hartford, Conn.

[22] Filed: Aug. 8, 1975

[21] Appl. No.: 603,006

[52] U.S. Cl. ..... 42/1 S; 33/233

[51] Int. Cl.[2] ..... F41G 1/46

[58] Field of Search ..... 42/1 S, 76 R, 79; 33/233

[56] References Cited

UNITED STATES PATENTS

| | | | |
|---|---|---|---|
| 2,869,271 | 1/1959 | Berg | 42/1 S |
| 2,874,504 | 2/1959 | Martinek | 42/1 S |
| 2,929,164 | 3/1960 | Browning | 42/1 S |
| 3,181,262 | 5/1965 | Bridge, Sr. | 42/1 S |
| 3,556,889 | 1/1971 | Grahn | 42/1 S |
| D228,757 | 10/1973 | Sanford | 42/1 S |

*Primary Examiner*—Charles T. Jordan

[57] ABSTRACT

A rib, either ventilated or solid, for handguns has a serrated center portion, nonserrated and curved edges on each side of the serrated center, and the rib is notched at the front end to surround the normal front sight of the handgun.

3 Claims, 4 Drawing Figures

RIB FOR HANDGUN

BACKGROUND OF THE INVENTION

Ribs for shotguns have been known and successfully used for a number of years. A design for such ribs is shown in U.S. Pat. No. De. 195,340; and a discussion of the features and advantages of such ribs as well as a method of installing such ribs on shotguns may be found in U.S. Pat. No. 3,556,889.

The desirability of using ribs, either ventilated or solid, on handguns has been recognized for several years, but no commercially acceptable version thereof has been forthcoming. Problems have been encountered in mounting the rib on the barrel of the handgun, compatibility with the front sight, and interference with inserting and removing the gun from its holster.

SUMMARY OF THE INVENTION

The above discussed and other problems of the prior art are overcome by the rib for handguns of the present invention. This rib is notched at the front end to surround the front sight, thus providing complete compatibility with the front sight and eliminating the need to remove and then remount the front sight. The top of the rib has a serrated center portion bounded on each side with a smooth curved edge portion. The serrated center portion cooperates with the front sight to provide a sight plane from the chamber to the front sight at the muzzle. The smooth and curved edge portions prevent snagging on the holster which might otherwise occur if the rib top were fully serrated.

The rib is mounted on the gun barrel with a mastic material thus allowing either for installation of the rib as original equipment or easy retrofitting. The rib and all material required for retrofitting is contained in a compact kit.

Accordingly, one object of the present invention is to provide a novel and improved rib for handguns.

Another object of the present invention is to provide a novel and improved rib for handguns which is compatible with the standard front sight of handguns and which will not interfere with insertion and removal of the gun from a holster.

Other objects and advantages of the present invention will be apparent to and understood by those skilled in the art from the following detailed description and the drawings.

BRIEF DESCRIPTION OF THE DRAWINGS

Referring now to the drawings, wherein like elements are numbered alike in the several figures.

DESCRIPTION OF THE PREFERRED EMBODIMENT:

The following description will be directed to a ventilated rib, but it will be understood that it is equally applicable to solid ribs.

Figure 1:
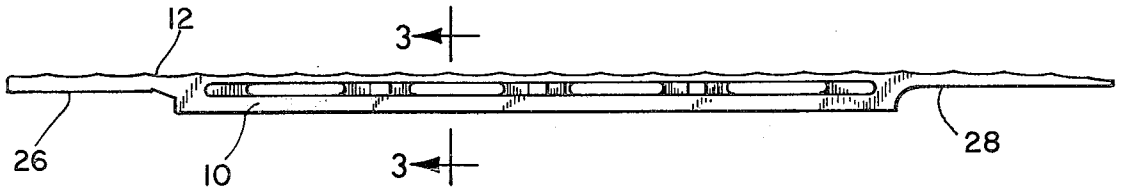
FIG. 1 is a side elevation view of a ventilated rib in accordance with the present invention.
Figure 2:
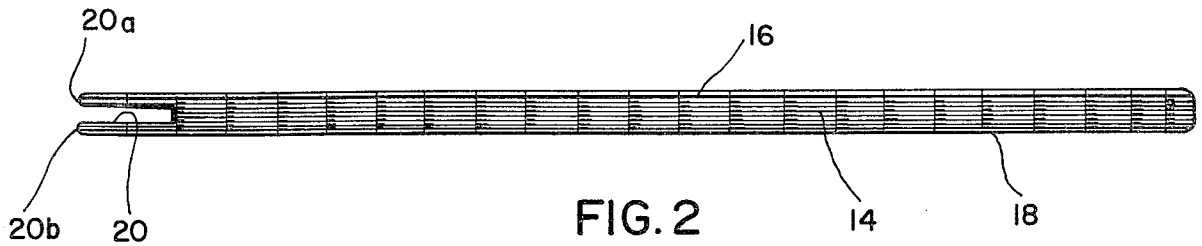
FIG. 2 is a top plan view of the rib of FIG. 1.
Figure 3:
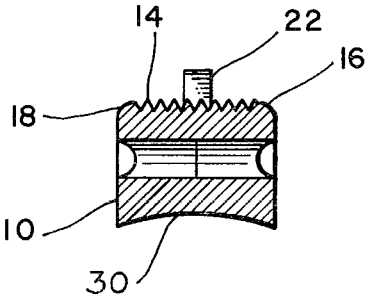
FIG. 3 is a view along line 3—3 of FIG. 1.

Referring jointly to FIGS. 1–3, ventilated rib 10 has an upper surface 12 which has a serrated central portion 14 and smooth edges 16 and 18. Smooth edges 16 and 18 are rounded as well as being smooth to eliminate any sharp edges that might snag or catch on a holster when inserting a handgun into or withdrawing it from a holster.

Rib 10 has a notch 20 at the front end thereof to surround the front sight 22 of a handgun (shown representatively in FIG. 3). This notch permits the rib to be mounted on the barrel of a handgun without disturbing in any way the mounting of the front sight. The forwardmost portions **20*a* and 20*b* of the rib at either side of the notch are also rounded or curved to prevent snagging on a holster. When mounted on a handgun, the rib extends from just forward of the chamber to the muzzle, with the notched portion 20 surrounding the front sight 22 of the gun. Central serrated portion 14 of the upper rib surface provides a sight plane from the chamber to the muzzle, with the tip of the standard front sight 22 visible above the serrated portion 14.** This sight plane serves to guide the shooter's eye and improves elevation sighting.

Rib 10 has a front segment 26 and a rear segment 28 to mate with the muzzle end and the chamber end, respectively, of a handgun. Rib 10 also has a curved lower surface 30 to mate with the upper curved surface of the gun barrel on which the rib is to be mounted. As will be recognized and appreciated by those skilled in the art, the shape or curvature of lower surface 30 and the shape or contour of the front and rear segments 26 and 28 (or the portions of the rib merging into the front and rear segments) will vary depending on the particular handgun on which the rib is to be mounted. Rear segment 28 must mate with the upper surface of the gun just forward of the chamber; front segment 26 must mate with the upper surface of the gun barrel in the vicinity of the muzzle, as well as having notch 20 surround the front sight; and lower surface 30 must conform to the contour of the barrel between the muzzle and the chamber.

Only the front sight 22 of a gun is shown in the drawings to illustrate the relationship between the front sight of a gun and the rib when the rib is installed. To install the rib, a suitable adhesive is applied to lower surface 30 and/or the upper surface of the gun at all places where the rib is to contact the gun. The rib is then positioned on the gun barrel with notch 20 surrounding front sight 22; and the rib is then taped to the gun barrel by wrapping tape around the rib and barrel. The taping is, of course, only a temporary measure to secure the rib in place until the adhesive sets. The tape is then removed, and any excess adhesive that has seeped out from between the rib and the gun barrel is scraped off. For a more detailed description of this mounting procedure and materials employed, reference is made to U.S. Pat. No. 3,556,889 where a suitable mounting procedure is fully described.

Figure 4:
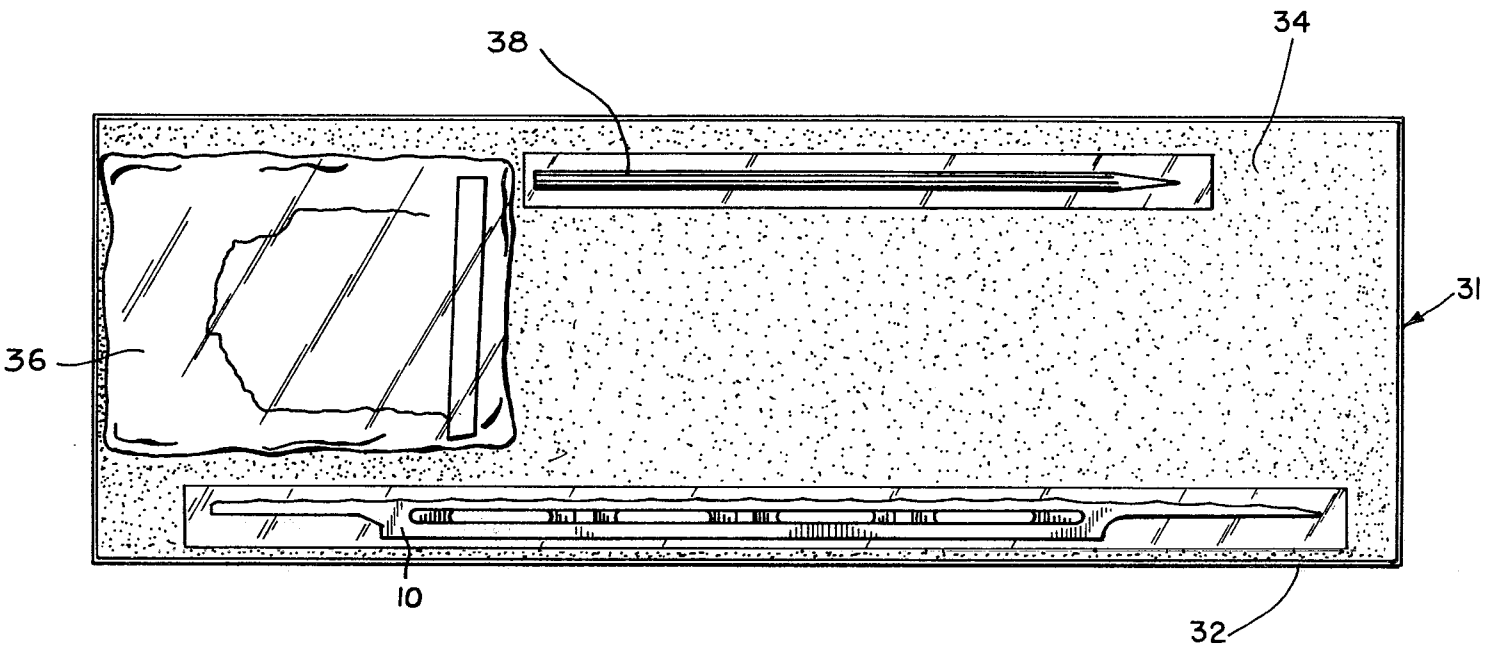
FIG. 4 is a view showing the kit for retrofitting the rib on a handgun.

For retrofitting handguns with the rib of the present invention, a kit 31 is shown in FIG. 4. Kit 31 has a plastic case 32 with the top part pivotal with respect to the bottom part to provide access to the interior. A foam pad 34 is located in the bottom part of case 32. Bonded to foam pad 34 by double faced tape are rib 10, a pouch 36 for the adhesive, and a scraper 38 for removing excess adhesive after setting. The kit is proportioned so that the upper part of case 32 forces rib 10 into the foam pad 34 to further secure rib 10 against movement during shipping and handling.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A gun sight rib for mounting on a barrel of a handgun, the handgun barrel having a sight extending upwardly therefrom adjacent the muzzle end thereof, said rib including:

an elongated rib body, said rib body having a central portion and oppositely disposed end portions, said end portions being of reduced thickness when compared to said central portion, the upper surfaces of said end and central portions cooperating to form said rib body upper surface, said rib body central portion having a curved lower surface contour to conform with the shape of the upper surface of the barrel of a handgun, said reduced thickness end portions respectively defining muzzle and chamber ends of said rib body;

a central serrated portion on said rib body upper surface, said central serrated portion extending from said chamber end to said muzzle end of said rib body to provide a sight plane;

smooth edge portions on each side of said central serrated portion on said upper surface; and a notch extending through said rib body end portion at the muzzle end thereof, said notch communicating with the muzzle end of said rib body and having a depth and width sufficient to accept the front sight of a handgun whereby the front sight will be surrounded by said rib on three sides.

2. A rib for mounting on a handgun as in claim 1 wherein:

said smooth edge portions are curved.

3. A rib for mounting on a hand gun as in claim 2 wherein:

the front edges of said muzzle end are curved.

* * * * *